US006029472A

United States Patent [19]

Galbreath, Sr.

[11] Patent Number: 6,029,472

[45] Date of Patent: Feb. 29, 2000

[54] REFRIGERANT RECYCLE AND RECLAIM SYSTEM

[76] Inventor: Charles E. Galbreath, Sr., P.O. Box 507, Westlake, La. 70669

[21] Appl. No.: 08/765,276

[22] PCT Filed: Sep. 27, 1996

[86] PCT No.: PCT/US96/15490

§ 371 Date: Dec. 20, 1996

§ 102(e) Date: Dec. 20, 1996

[87] PCT Pub. No.: WO98/13653

PCT Pub. Date: Apr. 2, 1998

[51] Int. Cl.[7] ..... F25B 43/04

[52] U.S. Cl. ..... 62/475; 62/149; 62/292; 62/77; 62/85

[58] Field of Search ..... 62/149, 292, 475, 62/77, 85

[56] References Cited

U.S. PATENT DOCUMENTS

| | | | |
|---|---|---|---|
| 4,903,499 | 2/1990 | Merritt . | |
| 5,172,562 | 12/1992 | Manz et al. | 62/149 |
| 5,203,177 | 4/1993 | Manz et al. | 62/149 |
| 5,212,959 | 5/1993 | Galbreath, Sr. . | |
| 5,226,300 | 7/1993 | Christensen et al. . | |
| 5,291,743 | 3/1994 | Van Steenburgh, Jr. . | |
| 5,359,859 | 11/1994 | Bench et al. . | |
| 5,361,594 | 11/1994 | Young | 62/129 |
| 5,369,959 | 12/1994 | Pfefferlet et al. . | |
| 5,400,606 | 3/1995 | Scuderi . | |
| 5,400,613 | 3/1995 | O'Neal . | |
| 5,709,091 | 1/1998 | Todack | 62/292 |
| 5,758,506 | 6/1998 | Hancock et al. | 62/149 |
| 5,799,497 | 9/1998 | Sano et al. | 62/149 |
| 5,943,867 | 8/1999 | Thomas et al. | 62/77 |

FOREIGN PATENT DOCUMENTS

| | | |
|---|---|---|
| 3-95370 | 4/1991 | Japan . |
| 4-316973 | 11/1992 | Japan . |
| 1041833 | 9/1983 | U.S.S.R. . |

*Primary Examiner*—Henry Bennett
*Assistant Examiner*—Mark Shulman
*Attorney, Agent, or Firm*—Richard C. Litman

[57] ABSTRACT

A refrigerant recycle and reclaim system includes two liquid refrigerant receivers; a low and a high pressure compressor in fluid communication with each other, each having their own oil separator; a condenser; filter driers; a particular arrangement of check and block valves and a high pressure float proximate the receivers; suction gas cooling components; and auxiliary devices. The suction gas cooling components include an expansion valve, a filter drier, a solenoid valve, and a mixer with sensor. The auxiliary devices include level switches, relief valves, purity sensors, and solenoids. The check and block valves, in combination with the high pressure float, automatically select which liquid receiver the refrigerant will therein be contained. The cooling components serve to lower the temperature of heat-intensive suction gases before entering into the low pressure compressor. The auxiliary devices help serve to continuously recycle refrigerants up to 275 PSIG.

20 Claims, 2 Drawing Sheets

REFRIGERANT RECYCLE AND RECLAIM SYSTEM

CROSS REFERENCE TO RELATED APPLICATIONS

The present application claims the priority benefit of the Patent Cooperation Treaty (PCT) application Ser. No. US 96/15490 filed Sep. 27, 1996.

BACKGROUND OF THE INVENTION

1. Field of the Invention

The present invention relates to refrigerant recovery systems, and particularly to an apparatus for recycling and reclaiming high and low pressure refrigerants in both vapor and/or liquid phases.

2. Description of Prior Art

Due to environmental and fiscal concerns, venting chlorofluorocarbon and halogenated chlorofluorocarbon refrigerants into the atmosphere is not only prohibited by law in most countries, but also by undue expense. In the past, venting occurred when an air conditioning or refrigeration system needed to be repaired and/or have its refrigeration fluid replaced due to contamination. Contamination occurs when moisture and/or burned and acidic lubricating oil mixes with the refrigerants. Contaminated refrigerants and refrigerants containing air are inefficient and inevitably have to be replaced.

Merely replacing the old refrigerant with new is economically inefficient. It is therefore desirable to develop an apparatus which can reclaim and recycle chlorofluorocarbon and halogenated chlorofluorocarbon refrigerants, as well as some of the newer type refrigerants. Many attempts have been made.

Examples of these attempts include U.S. Pat. No. 5,212,959 issued May 25, 1993 to Galbreath, Sr.; U.S. Pat. No. 5,291,743 issued Mar. 8, 1994 to Van Steenburgh, Jr. et al.; U.S. Pat. No. 5,400,606 issued Mar. 28, 1995 to Scuderi; U.S. Pat. No. 5,400,613 issued Mar. 28, 1995 to O'Neal; U.S. Pat. No. 5,359,859 issued Nov. 1, 1994 to Bench et al.; and U.S. Pat. No. 5,226,300 issued Jul. 13, 1993 to Christensen et al.

Galbreath, Sr. discloses a vapor and liquid phase refrigerant fluid processing and transferring system having low and high pressure compressors, a suction regulator and accumulator, an oil separator proximate the high pressure compressor, a condenser, a pair of liquid refrigerant receivers manually selectable by the user, two filter driers, and other auxiliary devices. Galbreath, Sr. does not disclose the automatic selection of two liquid receivers by a particular arrangement of check and block valves and a high pressure float; protection of the low pressure compressor from heat-intensive suction gases passing therethrough by a particular arrangement of an expansion valve, filter drier, solenoid valve, and mixer with sensor; and continuous processing of a refrigerant until the ARI 700 standard mandated by law is reached for resale to a third party.

Van Steenburgh, Jr. et al. discloses a liquid phase refrigerant fluid reclaim apparatus with automatic air purge having an evaporator, oil separator, compressor, condenser, a single storage tank, and a filter drier. The air purge system has the evaporator located within the storage to concentrate noncondensable gases before purging so as to minimize refrigerant losses.

Scuderi discloses a liquid phase refrigerant fluid reclaim apparatus having a strainer, condenser, compressor, two discriminator chambers, a single recovery tank, and other auxiliary devices. The apparatus is designed to prevent liquid phase refrigerant fluid from entering the compressor and for avoiding overfilling the recovery tank with liquid phase refrigerant fluid.

O'Neal discloses a portable purging apparatus that automatically removes air and noncondensables using a cooling coil in a system not unlike that of Van Steenburgh, Jr. et al., with the exception that a thermostat actuates a purging solenoid valve to discharge non-condensable gases.

Bench et al. discloses a vapor and liquid phase refrigerant fluid method for reclaiming and recycling both high and low temperature refrigerants. The method discloses cleaning a vapor phase refrigerant, compressing it, condensing it through a pair of heat exchangers, storing it in a single receiving tank, and recycling it by rerouting the liquid phase refrigerant after it absorbs heat produced by a high stage refrigerant system.

Christensen et al. discloses a vapor and liquid phase refrigerant fluid recycling apparatus, method and system having a fluid filter, an expansion valve, a pair of heat exchangers, a compressor, oil separator, condenser, and a single receiving tank.

Other relevant patents include U.S. Pat. No. 4,903,499 issued Feb. 27, 1990 to Merritt; and U.S. Pat. No. 5,369,959 issued Dec. 6, 1994 to Pfefferle et al.; Japanese Publication Nos. 3-95370 on Apr. 19, 1991; and 4-316973 on Nov. 9, 1992; and Soviet Union No. 1041833 of Sept. 15, 1983.

None of the above inventions and patents, taken either singularly or in combination, is seen to describe the instant invention as claimed. Thus a refrigerant recycle and reclaim system solving the aforementioned problems is desired.

SUMMARY OF THE INVENTION

In the instant invention, a recycle and reclaim refrigerant fluid system processes both high and low pressure refrigerants in vapor and/or liquid phases. The recycle and reclaim refrigerant system can be used on all chlorofluorocarbon and hydrofluorocarbon refrigerants and most new type refrigerants up to 275 pounds per square inch gage (PSIG). The instant invention includes two liquid refrigerant receivers; a low and a high pressure compressor in fluid communication with each other, each compressor having its own oil separator; a condenser; filter driers; a particular arrangement of check and block valves and a high pressure float proximate the receivers; suction gas cooling components; and auxiliary devices.

The suction gas cooling components include an expansion valve, a filter drier, a solenoid valve, and a mixer with sensor. The cooling components serve to lower the temperature of the hot suction gases before they enter into the low pressure compressor. Because the low pressure compressor is in fluid communication with the high pressure compressor, the low pressure compressor serves to boost the pressure on the vapor phase refrigerant, enabling both low and high pressure refrigerant fluids to be recycled and reclaimed.

The particular arrangement of check and block valves, in combination with a high pressure float, automatically select which liquid refrigerant receiver the condensed or liquid phase refrigerant will therein be contained. The auxiliary devices include level switches, relief valves, purity sensors, and solenoids. These devices cooperate with the particular arrangement of check and block valves and high pressure float to continuously recycle the liquid phase refrigerant fluid until the ARI 700 standard mandated by law is reached for resale to a third party.

Accordingly, it is a principal object of the invention to create an efficient vapor and liquid phase refrigerant fluid system for reclaiming and recycling both high and low pressure refrigerants.

It is another object of the invention to have a vapor and liquid phase refrigerant fluid system which automatically selects one of two liquid receivers for reclaiming and recycling refrigerants.

It is a further object of the invention to protect the low pressure compressor of a recycle and reclaim refrigerant system from heat-intensive suction gases passing therethrough.

Still another object of the invention is to provide a recycle and reclaim refrigerant system which continuously processes a refrigerant until the ARI 700 standard mandated by law is reached for resale to a third party.

It is yet another object of the invention to separate oil from high pressure, high temperature vapor phase refrigerant fluid directly after leaving the low and high pressure compressors, respectively, and recirculate the oil derived from separation back to the low and high pressure compressors, respectively, in a refrigerant recycle and reclaim system.

It is an object of the invention to provide a low pressure compressor which serves to boost the pressure on any vapor phase refrigerant fluid before it enters into a high pressure compressor of a refrigerant recovery system.

It is also an object of the invention to provide improved elements and arrangements thereof in a refrigerant recycle and reclaim system for the purposes described which is inexpensive, dependable, and fully effective in accomplishing its intended purposes.

These and other objects of the present invention will become readily apparent upon further review of the following specification and drawings.

DETAILED DESCRIPTION OF THE PREFERRED EMBODIMENT

Figure 1:
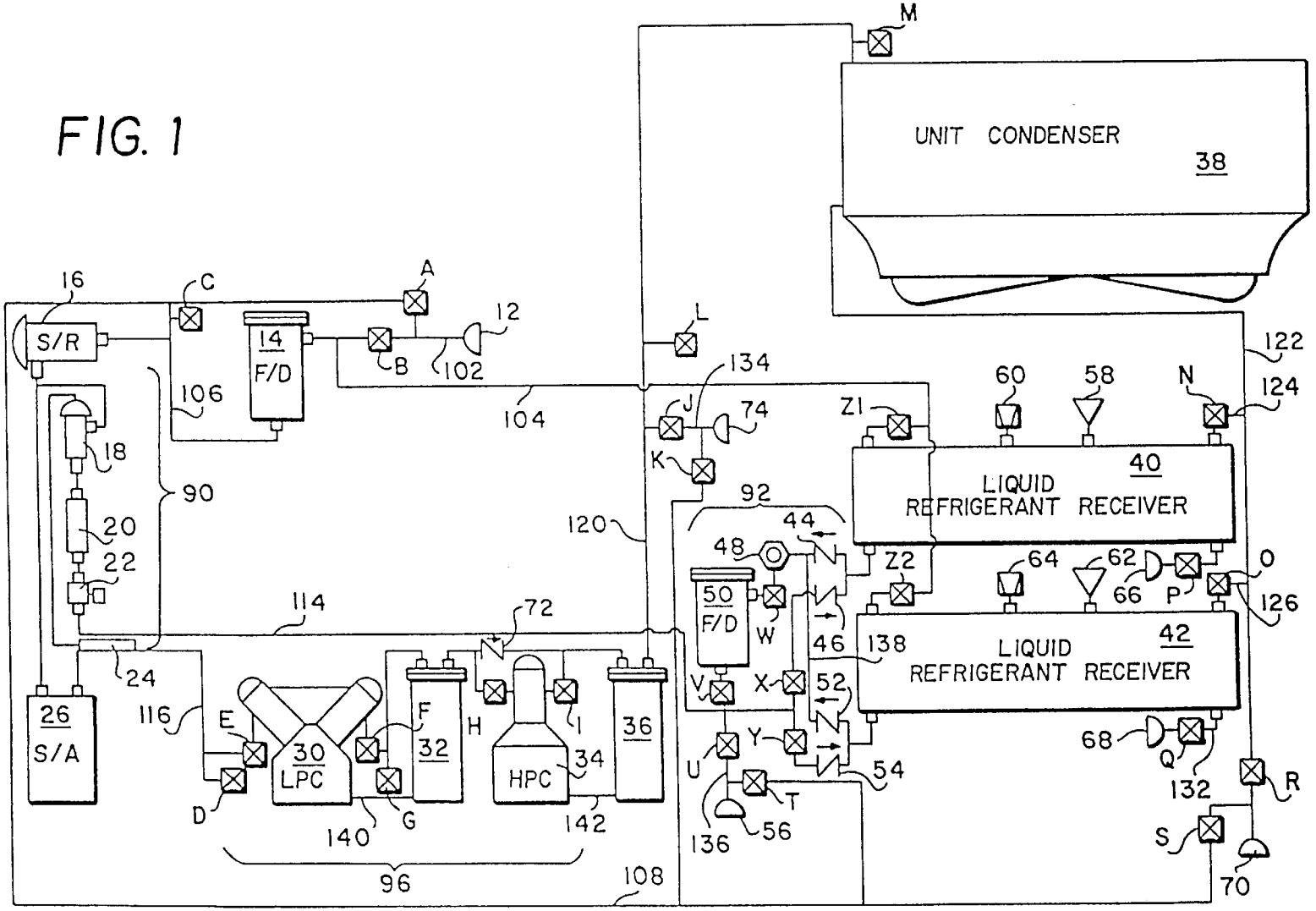
FIG. 1 is a block diagram view of the present invention.

As seen in FIG. 1, the refrigerant reclaim and recycle system 10 includes a suction inlet connector 12 in fluid communication with a first filter drier 14. The suction inlet connector 12 is connected to suction pump down valve A and suction inlet valve B by conduit 102. Conduit 104 interlinks suction inlet valve B and the first filter drier 104. A suction regulator 16 and a suction accumulator 26 are connected by conduit 107, wherein the suction regulator 16 is in fluid communication with the first filter drier 14 and a primary suction port C by conduit 106.

A suction gas cooling means 90, interlinked with the suction regulator 16 via conduit 110, includes an expansion valve 18, a second filter drier 20, a solenoid valve 22, and a mixer with sensor 24. The sensor within the mixer with sensor 24 is a bulb filled with gas. The mixer with sensor 24 is in fluid communication with the expansion valve 18 via conduit 112.

Conduit 116 interconnects the suction accumulator 26, the mixer with sensor 24, and a low pressure compressor (LPC) 30. A regulated suction valve D and a LPC inlet block valve E are on the low side (low pressure/inlet side) of LPC 30. On the high side (high pressure/outlet side) of LPC 30 is LPC outlet valve F and intermediate pressure valve G. First oil separator 32 is interconnected between LPC 30 and a high pressure compressor (HPC) 34 via conduit 116. On the inlet side of HPC 34 is check valve 72 and HPC inlet valve H. On the outlet side of HPC 34 is HPC outlet valve I and a second oil separator 36 interlinked by conduit 116. First oil separator 32 is also connected to LPC 30 via conduit 140. Second oil separator 36 is also connected to HPC 34 via conduit 142.

Second oil separator 36 is connected to a unit condenser 38 by conduit 120. Vapor phase discharge outlet valve J, vapor phase outlet valve L, and purge connection M are in fluid communication with conduit 120. Vapor phase discharge outlet valve J is in fluid communication with a vapor phase discharge outlet 74 and a vapor phase discharge pump down outlet valve K via a conduit 134. Conduit 134 is joined to conduit 108.

Conduit 122 is joined to conduit 124 and conduit 126, connecting unit condenser 38 with a first liquid receiver 40, and second liquid receiver 42, respectively. Condensed refrigerant drain outlet valve R is in fluid communication with a condensed refrigerant drain 70 via conduit 122. A condensed refrigerant pump down valve S is in fluid communication with the condensed refrigerant drain 70, the suction inlet pump down valve A, vapor phase discharge pump down outlet valve K, and a liquid phase pump down valve T along conduit 108.

A first condensed refrigerant inlet valve N and a second condensed refrigerant inlet valve O are in fluid communication with the first and second liquid receivers 40, 42 via conduits 124 and 126, respectively. First liquid drain outlet valve P and first liquid drain 66 are in fluid communication with the first liquid receiver 40 via conduit 130. Second liquid drain outlet valve Q and second liquid drain 68 are in fluid communication with the second liquid receiver 42 via conduit 132.

Auxiliary devices including a first level switch 58 and a first: relief valve 60, and a second level switch 62 and a second relief valve 64, are in fluid communication with the first and second liquid receivers, 40, 42, respectively. Conduit 104 connects a first vapor phase receiver output valve Z1 to the first liquid refrigerant receiver 40. Conduit 104 also connects a second vapor phase receiver output valve Z2 to the second liquid refrigerant receiver 42.

On the output side of solenoid valve 22, conduit 114 joins conduit 136, as well as conduit 138. A liquid phase suction inlet/outlet connector 56, a liquid phase connector valve U, a liquid phase filter drier output valve V, and a third filter drier 50 are interconnected by conduit 136. Conduit 138 is in fluid communication with the third filter drier 50.

Conduit 138 interlinks second and third check valves 44, 46 to the first liquid receiver 40, and fourth and fifth check valves 52, 54 to the second liquid receiver 42. A high pressure float 48, liquid phase filter drier input valve W, first liquid refrigerant inlet valve X, and second liquid refrigerant inlet valve Y are interconnected by conduit 138. Automatic selection means 92 includes high pressure float 48, check valves 44, 46, 52, 54, liquid phase filter drier input and output valves W, V, and first and second liquid refrigerant inlet valves X, Y.

As can be seen in FIG. 1, first and second liquid refrigerant inlet valves X, Y are proximate the junction point between conduits 138 and 114. Similarly, liquid phase connector valve U and liquid phase filter drier output valve V are proximate the junction point between conduits 136 and 114. Liquid phase filter drier input valve W is proximate the third filter drier 50 and the high pressure float 48.

Figure 2:
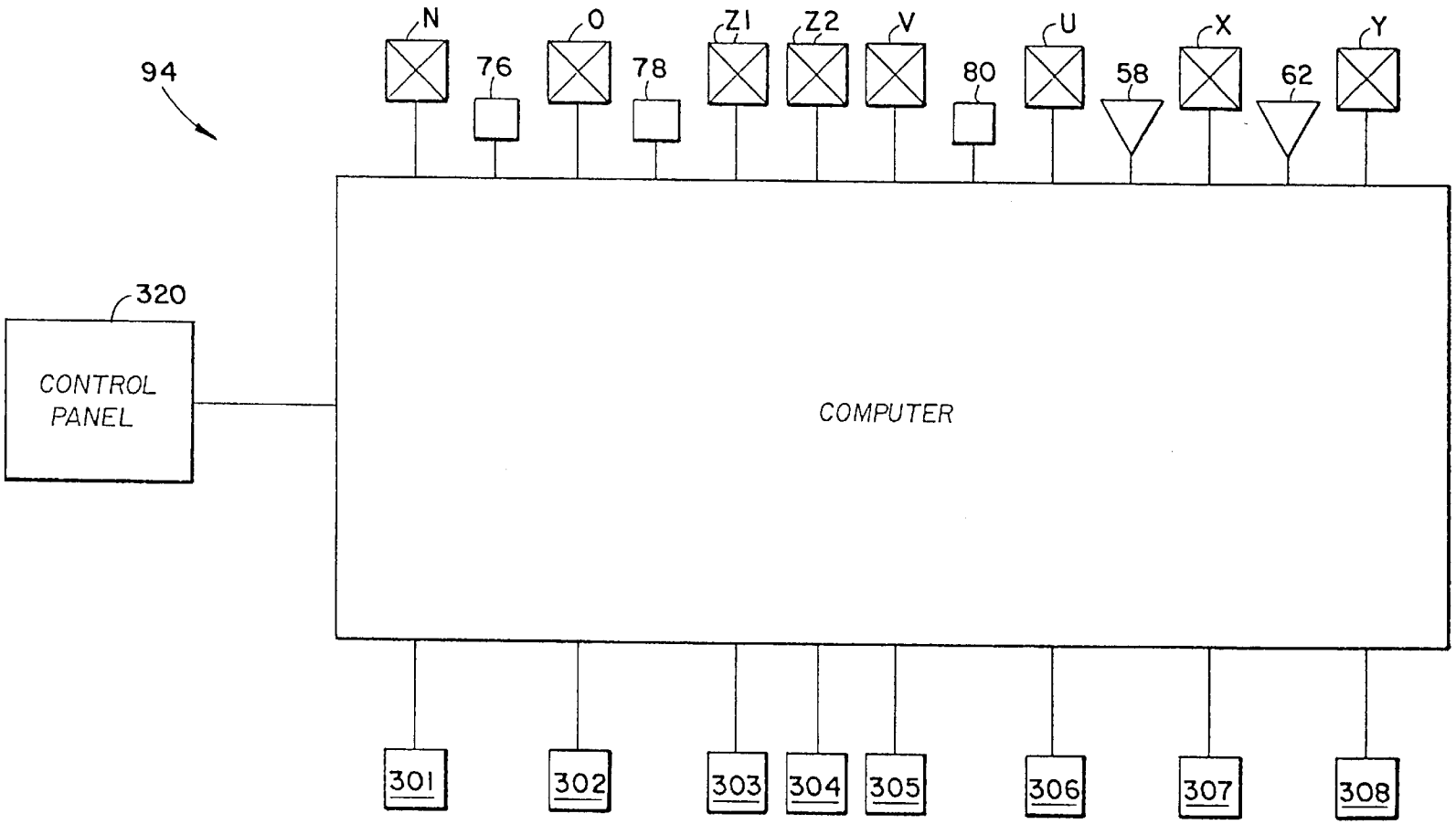
FIG. 2 is a block diagram of the continuous recycling system within the present invention.

As can be seen in FIG. 2, continuous recycling means includes a control panel 320, a computer 322, solenoids 301–308, purity sensors 76–80, first and second level switches 58, 62, and the series of (block) valves including N, O, V–Y, Z1 and Z2. Control panel 320 is in communication with the computer 322. The control panel 320 is accessible to the user for operating the refrigerant recycle and reclaim system 10. The computer 322 is connected to the solenoids 301–308, purity sensors 76–80, first and second level switches 58, 62, and valves including N, O, V–Y, Z1 and Z2. Solenoids 301–308 control the opening/closing of valves N, O, V–Y, Z1 and Z2.

In operation, the refrigerant recycle and reclaim system 10 may be transported to the cite of the air conditioning or refrigeration system to be repaired or maintained. The only external utility needed at the site is a suitable electrical power supply.

If the refrigerant line of the air conditioning or refrigeration system to be repaired or maintained handles refrigerants predominantly in vapor form, then suction inlet connector 12 should be connected to the refrigerant line of the system to be repaired or maintained. If the refrigerant line of the air conditioning or refrigeration system to be repaired or maintained handles refrigerants predominantly in liquid form, then liquid phase suction inlet/outlet connector 56 should be connected to the refrigerant line of the system to be repaired or maintained.

After the appropriate connector 12 or 56 is connected, the LPC 30 is used to pump out the pressure in the refrigerant line of the system to be repaired or maintained down to twenty five inches of vacuum. Once pumped down, suction inlet valve B is opened, as well as a particular configuration of valves depending on the desires of the user inputted into the control panel 320.

For example, with respect to refrigerants predominantly in vapor form, if the user desires to fill the first liquid receiver 40, the user indicates as such on the control panel 320, and the computer 322 activates solenoids 301, 304, 305, 308 in order to open valves N, Z2, V, Y, respectively. Conversely, if the user desires to fill the second liquid receiver 42, the user indicates as such on the control panel 320, and the computer 322 activates solenoids 302, 303, 305, 307 in order to open valves O, Z1, V, X, respectively.

Furthermore, with respect to refrigerants predominantly in liquid form, if the user desires to fill the first liquid receiver 40, the user would open valve U in fluid communication with solenoid 306, valve X, valve O and valve Z1. Conversely, if the user desires to fill the second liquid refrigerant receiver, the user would open valve U, valve Y, valve N, and valve Z2.

The first and second liquid receivers 40, 42 become filled by processing and/or condensing the refrigerant which has entered into inlets 12 or 56. More particularly, the predominantly vapor phase refrigerant entering into suction inlet connector 12 is cleaned and dried by passing through the first filter drier 14. After being cleaned and dried, the refrigerant is suctioned towards LPC 30 through the suction regulator 16 and suction accumulator 26 via conduits 106, 107. The low pressure placed onto the refrigerant causes any liquid phase refrigerant entering into the suction inlet connector 12 to exit the suction accumulator 26 in a vapor phase.

As such, low pressure vapor phase refrigerant passes through mixer with sensor 24, LPC inlet block valve E, LPC 30, LPC outlet valve F, first oil separator 32, HPC inlet valve H, HPC 34, HPC outlet valve I, and second oil separator 36. As the refrigerant passes through the LPC 30, the high pressure vaporous refrigerant is further processed by passing through the first oil separator 32 which removes moisture and/or burned and acidic lubricating oil and/or other particle contaminants.

One advantage of the present invention is that all chlorofluorocarbon and halogenated chlorofluorocarbon refrigerants and most new type refrigerants up to 275 PSIG can be recycled and reclaimed. This is due to booster means 96, including the arrangement of the LPC 30 and the HPC 34. The LPC 30 acts as a booster to the vaporous refrigerant entering into the HPC 34, thereby allowing both low and high pressure refrigerants to be recycled and reclaimed. Furthermore, first check valve 72 ensures that high pressure vaporous refrigerant exiting the HPC 34 will not be forced back into the first oil separator 32, but rather into the second oil separator 36. Intermediate pressure valve G ensures that the pressure is properly regulated between the LPC 30 and HPC 34 such that both will function correctly. Similar to the first oil separator 32, the second oil separator 36 removes moisture and/or burned and acidic lubricating oil and/or other particle contaminants.

Some of the oil recovered from the refrigerant passing through the first and second oil separators 32, 36 is returned to the LPC 30 and HPC 34 via conduits 140, 142, respectively. This arrangement is well known in the art. Similarly, the components including filter driers 14, 20, 50, suction regulator 16, suction accumulator 26, LPC 30, HPC 34, oil separators 32, 36, and unit condenser 38, are conventional devices well known in the art.

If the user desires to discharge the processed vapor phase refrigerant, vapor phase discharge outlet valve J is opened, allowing the processed refrigerant to exit out vapor phase discharge outlet 74 and into an exterior storage container. On the other hand, if the user desires to store the processed vapor phase refrigerant as a processed liquid phase refrigerant, the user maintains discharge outlet valve J in a closed position, allowing the processed vapor phase refrigerant to condense upon passing through unit condenser 38. As noted above, this permits the user to store the condensed refrigerant in either the first or second liquid receivers 40, 42. However, if the user desires to store the processed condensed refrigerant outside of the refrigerant recycle and reclaim system 10, the user opens condensed refrigerant drain outlet valve R and closes valves N, O, thereby allowing the refrigerant to exit out condensed refrigerant drain 70.

If the user has chosen to store the condensed refrigerant in the first liquid receiver 40, liquid refrigerant will begin filling its interior, while passing through check valve 44 and filling the interior of high pressure float 48. Once the pressure is high enough to reach a predetermined limit set in the high pressure float 48, high pressure float automatically opens valve W. Ideally, the pressure limit will be set such the first liquid receiver 40 will be full with condensed refrigerant. Such automatic selection of liquid refrigerant receivers 40, 42 is another advantage of the present invention.

Once the high pressure float 48 has opened valve W, liquid refrigerant will be allowed to fill the interior of the second liquid receiver 42. Because first vapor phase receiver output valve Z2 is open, the liquid refrigerant filling the second liquid receiver 42 will be boiling due to the low pressure suction applied on the system 10 by LPC 30 and HPC 34. As such, vapor phase refrigerant will exit valve Z2, pass through conduit 104 and into the first filter drier 14 to begin the above-mentioned processing and condensing cycle once again.

If the user has chosen to store the condensed refrigerant in the second liquid receiver 42, liquid refrigerant will begin filling its interior, while passing through check valve 52 and filling the interior of high pressure float 48. Once the pressure is high enough to reach a predetermined limit set in the high pressure float 48, high pressure float automatically opens valve W. Ideally, the pressure limit will be set such the second liquid receiver 42 will be full with condensed refrigerant before emptying into the first liquid refrigerant receiver 40.

Once the high pressure float 48 has opened valve W, liquid refrigerant will be allowed to fill the interior of the first liquid receiver 40. Because first vapor phase receiver output valve Z1 is open, the liquid refrigerant filling the first liquid receiver 40 will be boiling due to the low pressure suction applied on the system 10 by LPC 30 and HPC 34. As such, vapor phase refrigerant will exit valve Z1, pass through conduit 104 and into the first filter drier 14 to begin the above-mentioned processing and condensing cycle once again. With respect to controlling any excess pressure within liquid refrigerant receivers 40, 42, safety relief valves 60, 64 are set to open at 300 PSIG, respectively.

Yet another advantage of the instant invention is such that the refrigerant contained within the system 10 will be continuously processed until the ARI 700 standard necessary for reclaim status is reached. This is due to the continuous recycling means 94 which cooperates with the automatic selection means 92 described above.

If the user has chosen to fill the first liquid refrigerant receiver 40, vapor phase refrigerant will be continuously processed and condensed until the computer 322 indicates that the second liquid refrigerant receiver 42 contains both the requisite quantity and purity of liquid refrigerant. The computer 322 has input from purity sensor 76 located directly above valve N, purity sensor 80 located directly above valve V, and level switch 62. When the purity sensors 76, 80 indicate that ARI 700 reclaim status has been achieved, the computer 322 will send a signal to the control panel 320 for shutting down the system 10 once the second liquid refrigerant receiver 42 is full. Conversely, if the user has initially chosen to fill the second liquid refrigerant receiver 42, the computer 322 will have input from purity sensor 78 located directly above valve O, purity sensor 80 located directly above valve V, and level switch 58.

With respect to the refrigerant entering into suction inlet connector 56 and entering into the first or second liquid refrigerant receiver 40 or 42, the liquid refrigerant will pass through valves U and X and check valve 46, or through valves U and Y, and check valve 54, respectively. Vapor phase refrigerant will then exit valve Z1 or Z2, respectively, and be processed and condensed as described above, entering into the second liquid refrigerant receiver 42 at valve O, or the first liquid receiver 40 at valve N. Once the second or first liquid receiver 42, 40 is full, the automatic selection means 92 and continuous recycling means 94 will function in the manner described above.

Yet another advantage of the present invention is such that high temperature vapor phase refrigerant will not be allowed to cause damage to the LPC 30. This advantage is due to the suction gas cooling means 90. If the suction gases containing high temperature vapor phase refrigerant near temperatures determined to cause damage to the LPC 30, the gas contained within the gas-filled bulb of the mixer with sensor 24 expands, causing the expansion valve 18 to modulate towards open. Conversely, if the gas-filled bulb feels a drop in temperature, the gas contained therein contracts and the expansion valve 18 modulates towards close.

Once the expansion valve 18 is opened, high pressure liquid phase refrigerant contained within the predominantly vapor phase refrigerant entering into suction inlet connector 12 will pass through conduit 110 and into expansion valve 18. Due to the adiabatic process, this high pressure liquid turns to vapor, causing a drop in temperature to the refrigerant. Any refrigerant which condenses due to this drop in temperature will be suctioned through the second filter drier 18, solenoid valve 22, and into conduit 114.

This processed condensed refrigerant will enter into either the first or second liquid receiver 40, 42, depending on whether the first or second liquid refrigerant inlet valve X or Y is open, respectively. Any refrigerant which does not condense and pass through conduit 114 will be suctioned through conduit 112 as low temperature vapor phase refrigerant. The amount of suction is regulated by regulated suction valve D such that only non-condensed suction gases pass through conduit 112. This low temperature vapor phase refrigerant intermingles with the high temperature vapor phase refrigerant passing through conduit 107 and into the mixer with sensor 24. As such, the suction gases entering into LPC 30 have now been cooled so that damage will not occur to the LPC 30.

Once the control panel indicates that the requisite purity has been obtained throughout the system 10 through continuous recycling, the user should evacuate the lines connected to the system to be repaired or maintained. Evacuation is achieved by closing all valves except the pump down valve connected to the line to be evacuated. For example, if a line connected to the suction inlet connector 12 is to be evacuated, then the suction pump down inlet valve A is opened. If a line connected to the vapor phase discharge outlet 74 is to be evacuated, then the vapor phase discharge pump down outlet valve K is opened. If a line connected to the liquid phase suction inlet/outlet connector 56 is to be evacuated, then the liquid phase pump down valve T is opened. If a line connected to the first or second liquid drain 66, 68 is to be evacuated, then first or second drain outlet valve P, Q is opened, respectively. Once the appropriate valves are opened, the LPC 30 is activated and the appropriate line connected to the system to be maintained or repaired is evacuated to about twenty five inches of vacuum.

It is to be understood that the present invention is not limited to the embodiment described above, but encompasses any and all embodiments within the scope of the following claims.

I claim:

1. A refrigerant recycle and reclaim system comprising:

a suction inlet connector for receiving predominantly vapor phase refrigerant;

a first filter drier for cleaning and drying refrigerant passing therethrough, said first filter drier in fluid communication with said suction inlet connector;

a suction regulator in fluid communication with said first filter drier;

a suction accumulator in fluid communication with said suction regulator;

a suction gas cooling means for cooling heat-intensive suction gases leaving said suction accumulator, said suction gas cooling means in fluid communication with said suction regulator and said suction accumulator;

a booster means for recycling chlorofluorocarbon and halogenated chlorofluorocarbon refrigerants and most refrigerants up to 275 pounds per square inch gage, said booster means in fluid communication with said suction gas cooling means and said suction accumulator;

a condenser in fluid communication with said booster means;

a first and a second liquid refrigerant receiver in fluid communication with said condenser;

an automatic selection means for automatically selecting said first or said second liquid refrigerant receiver, said automatic selection means in fluid communication with said first liquid refrigerant receiver, said second liquid refrigerant receiver, and said suction gas cooling means; and a liquid phase suction inlet/outlet connector for receiving predominantly liquid phase refrigerant and discharging processed liquid phase refrigerant, said liquid phase suction inlet/outlet connector in fluid communication with said automatic selection means, whereby both vapor and liquid phase chlorofluorocarbon and halogenated chlorofluorocarbon refrigerants and most refrigerants up to 275 pounds per square inch gage can be recycled and reclaimed.

2. The refrigerant recycle and reclaim system as defined in claim 1 wherein said booster means includes:

a low pressure compressor in fluid communication with said suction gas cooling means and said suction accumulator;

a first oil separator for removing moisture and/or burned and acidic lubricating oil and/or other particle contaminants from refrigerant passing therethrough, said first oil separator in fluid communication with said low pressure compressor;

a high pressure compressor in fluid communication with said first oil separator; and a second oil separator for removing moisture and/or burned and acidic lubricating oil and/or other particle contaminants from refrigerant passing therethrough, said second oil separator in fluid communication with said high pressure compressor and said condenser.

3. The refrigerant recycle and reclaim system as defined in claim 2 wherein said booster means further includes:

a regulated suction valve interconnecting said low pressure compressor, said suction accumulator, and said mixer with sensor;

an intermediate pressure valve interconnecting said low pressure compressor and said first oil separator; and a first check valve for preventing high pressure vaporous refrigerant exiting said high pressure compressor to enter into said first oil separator, said first check valve interconnecting said first oil separator and said high pressure compressor.

4. The refrigerant recycle and reclaim system as defined in claim 2 wherein said suction gas cooling means includes:

an expansion valve in fluid communication with said suction regulator;

a second filter drier in fluid communication with said expansion valve;

a solenoid valve in fluid communication with said second filter drier; and a mixer with sensor in fluid communication with said expansion valve, said suction accumulator, and said low pressure compressor.

5. The refrigerant recycle and reclaim system as defined in claim 4 wherein said mixer with sensor includes a gas-filled bulb interconnected to said expansion valve, wherein said gas-filled bulb causes said expansion valve to modulate towards open when suction gases entering into said low pressure compressor near temperatures determined to cause damage to said low pressure compressor.

6. The refrigerant recycle and reclaim system as defined in claim 3 wherein said first and second oil separators each have a conduit for returning oil separated from refrigerant passing therethrough to said low pressure compressor and said high pressure compressor, respectively.

7. The refrigerant recycle and reclaim system as defined in claim 2 wherein said first and said second liquid refrigerant receiver each includes a level switch, a relief valve, and a liquid drain.

8. The refrigerant recycle and reclaim system as defined in claim 3 wherein said automatic selection means includes:

a second check valve in fluid communication with said first liquid refrigerant receiver;

a third check valve in fluid communication with said second check valve and said first liquid refrigerant receiver;

a high pressure float in fluid communication with said second check valve;

a liquid phase filter drier input valve in fluid communication with said high pressure float, wherein refrigerant enters said high pressure float and automatically exits therefrom;

a fourth check valve in fluid communication with said high pressure float and said second liquid refrigerant receiver;

a fifth check valve in fluid communication with said fourth check valve and said second liquid refrigerant receiver; and a second filter drier in fluid communication with said liquid phase filter drier input valve and said third and fifth check valves.

9. The refrigerant recycle and reclaim system as defined in claim 8 further comprising a continuous recycling means in fluid communication with said automatic selection means, said continuous recycling means including:

a control panel accessible to a user for operating said refrigerant recycle and reclaim system;

a computer in communication with said control panel;

a first level switch, a first condensed refrigerant inlet valve, and a first vapor phase receiver output valve in communication with said computer and said first liquid refrigerant receiver, said first condensed refrigerant inlet valve in fluid communication with a first purity sensor and a first solenoid, said first vapor phase receiver output valve in fluid communication with a second solenoid;

a second level switch, a second condensed refrigerant inlet valve, and a second vapor phase receiver output valve in communication with said computer and said second liquid refrigerant receiver, said second condensed refrigerant inlet valve in fluid communication with a second purity sensor and a third solenoid, said second vapor phase receiver output valve in fluid communication with a fourth solenoid;

a liquid phase filter drier output valve in fluid communication with said second filter drier, said liquid phase filter drier output valve in fluid communication with a fifth solenoid and a third purity sensor;

a liquid phase connector valve in fluid communication with said liquid phase filter drier output valve, said liquid phase connector valve in fluid communication with a sixth solenoid; and a first and a second liquid refrigerant inlet valve in fluid communication with said third and fifth check valves, respectively, said first liquid refrigerant inlet valve in fluid communication with a seventh solenoid, said second liquid refrigerant inlet valve in fluid communication with an eighth solenoid.

10. A refrigerant recycle and reclaim system for reclaiming and recycling chlorofluorocarbon and halogenated chlorofluorocarbon refrigerants and most refrigerants up to 275 pounds per square inch gage, said refrigerant recycle and reclaim system comprising:

a suction inlet connector for receiving predominantly vapor phase refrigerant;

a first filter drier for cleaning and drying refrigerant passing therethrough, said first filter drier in fluid communication with said suction inlet connector;

a suction regulator in fluid communication with said first filter drier;

a suction accumulator in fluid communication with said suction regulator;

a booster means for recycling high pressure refrigerants up to 275 pounds per square inch gage, said booster means including:

a low pressure compressor in fluid communication with said suction accumulator;

a first oil separator for removing moisture and/or burned and acidic lubricating oil and/or other particle contaminants from refrigerant passing therethrough, said first oil separator in fluid communication with said low pressure compressor;

a high pressure compressor in fluid communication with said first oil separator; and a second oil separator for removing moisture and/or burned and acidic lubricating oil and/or other particle contaminants from refrigerant passing therethrough, said second oil separator in fluid communication with said high pressure compressor;

a suction gas cooling means for cooling heat-intensive suction gases leaving said suction accumulator, said suction gas cooling means including:

an expansion valve in fluid communication with said suction regulator;

a second filter drier in fluid communication with said expansion valve;

a solenoid valve in fluid communication with said second filter drier; and a mixer with sensor in fluid communication with said expansion valve, said suction accumulator, and said low pressure compressor;

a condenser in fluid communication with said high pressure compressor;

a first and a second liquid refrigerant receiver in fluid communication with said condenser;

an automatic selection means for automatically selecting said first or said second liquid refrigerant receiver, said automatic selection means in fluid communication with said first liquid refrigerant receiver, said second liquid refrigerant receiver, and said solenoid valve; and a liquid phase suction inlet/outlet connector for receiving predominantly liquid phase refrigerant and discharging processed liquid phase refrigerant, said liquid phase suction inlet/outlet connector in fluid communication with said automatic selection means, whereby both vapor and liquid phase chlorofluorocarbon and halogenated chlorofluorocarbon refrigerants and most refrigerants up to 275 pounds per square inch gage can be recycled and reclaimed.

11. The refrigerant recycle and reclaim system as defined in claim 10 wherein said booster means further includes:

a regulated suction valve interconnecting said low pressure compressor, said suction accumulator, and said mixer with sensor;

an intermediate pressure valve interconnecting said low pressure compressor and said first oil separator; and a first check valve for preventing high pressure vaporous refrigerant exiting said high pressure compressor to enter into said first oil separator, said first check valve interconnecting said first oil separator and said high pressure compressor.

12. The refrigerant recycle and reclaim system as defined in claim 10 wherein said mixer with sensor includes a gas-filled bulb interconnected to said expansion valve, wherein said gas-filled bulb causes said expansion valve to modulate towards open when suction gases entering into said low pressure compressor near temperatures determined to cause damage to said low pressure compressor.

13. The refrigerant recycle and reclaim system as defined in claim 10 wherein said first and second oil separators each have a conduit for returning oil separated from refrigerant passing therethrough to said low pressure compressor and said high pressure compressor, respectively.

14. The refrigerant recycle and reclaim system as defined in claim 13 wherein said first and said second liquid refrigerant receiver each includes a level switch, a relief valve, and a liquid drain.

15. The refrigerant recycle and reclaim system as defined in claim 10 wherein said automatic selection means includes:

a second check valve in fluid communication with said first liquid refrigerant receiver;

a third check valve in fluid communication with said second check valve and said first liquid refrigerant receiver;

a high pressure float in fluid communication with said second check valve;

a liquid phase filter drier input valve in fluid communication with said high pressure float, wherein refrigerant enters said high pressure float and automatically exits therefrom;

a fourth check valve in fluid communication with said high pressure float and said second liquid refrigerant receiver;

a fifth check valve in fluid communication with said fourth check valve and said second liquid refrigerant receiver; and a third filter drier in fluid communication with said liquid phase filter drier input valve and said third and fifth check valves.

16. The refrigerant recycle and reclaim system as defined in claim 15 further comprising a continuous recycling means in fluid communication with said automatic selection means, said continuous recycling means including:

a control panel accessible to a user for operating said refrigerant recycle and reclaim system;

a computer in communication with said control panel;

a first level switch, a first condensed refrigerant inlet valve, and a first vapor phase receiver output valve in communication with said computer and said first liquid refrigerant receiver, said first condensed refrigerant inlet valve in fluid communication with a first purity sensor and a first solenoid, said first vapor phase receiver output valve in fluid communication with a second solenoid;

a second level switch, a second condensed refrigerant inlet valve, and a second vapor phase receiver output valve in communication with said computer and said second liquid refrigerant receiver, said second condensed refrigerant inlet valve in fluid communication with a second purity sensor and a third solenoid, said second vapor phase receiver output valve in fluid communication with a fourth solenoid;

a liquid phase filter drier output valve in fluid communication with said third filter drier, said liquid phase filter drier output valve in fluid communication with a fifth solenoid and a third purity sensor;

a liquid phase connector valve in fluid communication with said liquid phase filter drier output valve, said liquid phase connector valve in fluid communication with a sixth solenoid; and a first and a second liquid refrigerant inlet valve in fluid communication with said third and fifth check valves, respectively, said first liquid refrigerant inlet valve in fluid communication with a seventh solenoid, said second liquid refrigerant inlet valve in fluid communication with an eighth solenoid.

17. A refrigerant recycle and reclaim system for reclaiming and recycling chlorofluorocarbon and halogenated chlorofluorocarbon refrigerants and most refrigerants up to 275 pounds per square inch gage in vapor and/or liquid phases, said refrigerant recycle and reclaim system comprising:

a suction inlet connector for receiving predominantly vapor phase refrigerant;

a first filter drier for cleaning and drying refrigerant passing therethrough, said first filter drier in fluid communication with said suction inlet connector;

a suction regulator in fluid communication with said first filter drier;

a suction accumulator in fluid communication with said suction regulator;

a low pressure compressor in fluid communication with said suction accumulator;

a high pressure compressor in fluid communication with said low pressure compressor, wherein said low pressure compressor increases the compression ability of said refrigerant recovery and reclaim system for recycling high pressure refrigerants up to 275 pounds per square inch gage;

a first and a second oil separator for removing moisture and/or burned and acidic lubricating oil and/or other particle contaminants from refrigerant passing therethrough, said first and said second oil separator in fluid communication with said low and said high pressure compressors, respectively;

an expansion valve for adiabatically processing any high pressure liquid phase refrigerant passing therethrough, said expansion valve in fluid communication with said suction regulator;

a second filter drier in fluid communication with said expansion valve;

a solenoid valve in fluid communication with said second filter drier;

a mixer with sensor for cooling suction gases exiting said suction accumulator, said mixer with sensor in fluid communication with said expansion valve, said suction accumulator, and said low pressure compressor;

a condenser in fluid communication with said high pressure compressor;

a first and a second liquid refrigerant receiver in fluid communication with said condenser;

a second and a third check valve in fluid communication with said first liquid refrigerant receiver;

a fourth and a fifth check valve in fluid communication with said second liquid refrigerant receiver;

a high pressure float in fluid communication with said second and said fourth check valve;

a liquid phase filter drier input valve in fluid communication with said high pressure float, wherein liquid refrigerant enters said high pressure float and automatically exits said liquid phase filter drier input valve;

a third filter drier for cleaning and drying refrigerant passing therethrough, said third filter drier in fluid communication with said liquid phase filter drier input valve;

a computer in communication with said first and said second liquid refrigerant receivers;

a control panel accessible to a user for operating said refrigerant recycle and reclaim system, said control panel in communication with said computer;

a first level switch, a first condensed refrigerant inlet valve, and a first vapor phase receiver output valve in communication with said computer and said first liquid refrigerant receiver, said first condensed refrigerant inlet valve in fluid communication with a first purity sensor and a first solenoid, said first vapor phase receiver output valve in fluid communication with a second solenoid;

a second level switch, a second condensed refrigerant inlet valve, and a second vapor phase receiver output valve in communication with said computer and said second liquid refrigerant receiver, said second condensed refrigerant inlet valve in fluid communication with a second purity sensor and a third solenoid, said second vapor phase receiver output valve in fluid communication with a fourth solenoid;

a liquid phase filter drier output valve in fluid communication with said third filter drier, said liquid phase filter drier output valve in fluid communication with a fifth solenoid and a third purity sensor, wherein said first, second, and third purity sensors can detect when ARI 700 purification standard necessary for reclaims status to third parties is reached;

a liquid phase connector valve in fluid communication with said liquid phase filter drier output valve, said liquid phase connector valve in fluid communication with a sixth solenoid;

a first and a second liquid refrigerant inlet valve in fluid communication with said third and fifth check valves, respectively, said first liquid refrigerant inlet valve in fluid communication with a seventh solenoid, said second liquid refrigerant inlet valve in fluid communication with an eighth solenoid; and a liquid phase suction inlet/outlet connector for receiving predominantly liquid phase refrigerant and discharging processed liquid phase refrigerant, said liquid phase suction inlet/outlet connector in fluid communication with said liquid phase connector valve, whereby high temperature suction gases are cooled before entering said low pressure compressor, refrigerant automatically enters into said first or said second liquid refrigerant receiver once said liquid phase filter drier input valve is automatically opened, and both vapor and liquid phase chlorofluorocarbon and halogenated chlorofluorocarbon refrigerants and most refrigerants up to 275 pounds per square inch gage can be continuously recycled and reclaimed until ARI 700 necessary for reclaim status to third parties is reached.

18. The refrigerant recycle and reclaim system as defined in claim 17 wherein said mixer with sensor includes a gas-filled bulb interconnected to said expansion valve, wherein said gas-filled bulb causes said expansion valve to modulate towards open when suction gases entering into said low pressure compressor near temperatures determined to cause damage to said low pressure compressor.

19. The refrigerant recycle and reclaim system as defined in claim 18 wherein said first and second oil separators each have a conduit for returning oil separated from refrigerant passing therethrough to said low pressure compressor and said high pressure compressor, respectively.

20. The refrigerant recycle and reclaim system as defined in claim 19 wherein said first and second liquid refrigerant receivers each have a safety relief valve set at 300 pounds per square inch gage, a liquid drain, and a liquid drain outlet valve in fluid communication therewith.

* * * * *